United States Patent [19]

Nishikawa et al.

[11] 4,398,164

[45] Aug. 9, 1983

[54] COAXIAL RESONATOR

[75] Inventors: Toshio Nishikawa, Nagaokakyo; Sadahiro Tamura; Youhei Ishikawa, both of Kyoto; Haruo Matsumoto, Nagaokakyo, all of Japan

[73] Assignee: Murata Manufacturing Co., Ltd., Japan

[21] Appl. No.: 224,748

[22] Filed: Jan. 13, 1981

[30] Foreign Application Priority Data

Jan. 24, 1980 [JP] Japan ..... 55-7821[U]

[51] Int. Cl.[3] ..... H01P 7/04

[52] U.S. Cl. ..... 333/222; 220/DIG. 22; 333/206

[58] Field of Search ..... 333/222, 223, 206, 207, 333/224–226; 220/DIG. 22

[56] References Cited

U.S. PATENT DOCUMENTS

| | | | |
|---|---|---|---|
| 532,355 | 1/1895 | Bellinger | 220/DIG. 22 |
| 1,187,461 | 6/1916 | Knox | 220/DIG. 22 |
| 3,187,278 | 6/1965 | Wheeler | 333/226 |
| 3,277,406 | 10/1966 | Ocker | 333/206 X |
| 4,223,287 | 9/1980 | Nishikawa et al. | 333/206 |
| 4,245,198 | 1/1981 | Nishikawa et al. | 333/222 X |
| 4,276,525 | 6/1981 | Nishikawa et al. | 333/206 |

FOREIGN PATENT DOCUMENTS

| | | | |
|---|---|---|---|
| 816428 | 10/1951 | Fed. Rep. of Germany | 333/222 |

*Primary Examiner*—Paul L. Gensler

*Attorney, Agent, or Firm*—Ostrolenk, Faber, Gerb & Soffen

[57] ABSTRACT

A ¼ wave length coaxial resonator comprises an outer cylindrical portion, an inner cylindrical portion positioned coaxially in the outer cylindrical portion, with the outer and inner cylindrical portions connected at one end by a radial connecting portion, and a dielectric unit disposed therebetween. The outer cylindrical portion and the inner cylindrical portion and the radial connecting portion are formed with a unitary member of a metallic extruded material formed by means of an impact extruding process so that the inner cylindrical portion is positioned coaxially in the outer cylindrical portion. As a result, a space is formed between the outer cylindrical portion and the inner cylindrical portion to allow for insertion of a hollow cylindrical dielectric unit. One end of the above described metallic extruded member of a unitary material is formed as an opened end allowing for insertion of the dielectric unit, while the other end of the metallic extruded member is formed as a radial connecting portion for electrically short-circuiting the outer cylindrical portion and the inner cylindrical portion. The dielectric unit is formed with an outer conductor layer on the outer wall surface and an inner conductor layer on the inner wall surface. The dielectric unit is inserted only in the region close to the opened end or in the whole portion of the space between the outer cylindrical portion and the inner cylindrical portion.

11 Claims, 31 Drawing Figures

COAXIAL RESONATOR

BACKGROUND OF THE INVENTION

1. Field of the Invention

The present invention relates to a coaxial resonator. More specifically, the present invention relates to a $\frac{1}{4}$ wave length coaxial TEM resonator comprising a dielectric unit between an outer conductor and an inner conductor.

2. Description of the Prior Art

FIG. 1 is a sectional view of a $\frac{1}{4}$ wave length coaxial TEM resonator of the prior art and FIG. 2 is a sectional view taken along the line II—II in FIG. 1. Referring to FIGS. 1 and 2, a conventional $\frac{1}{4}$ wave length coaxial TEM resonator will be described. A dielectric unit 10 is made of a ceramic material of a titanium oxide group and formed in a hollow cylindrical shape having an outer wall surface and an inner wall surface. The dielectric unit 10 is provided on the outer wall surface with a cylindrical metallic member of an electrical conductor to constitute an outer conductor 21. More specifically, the outer conductor 21 is fitted onto the dielectric unit 10 so that the inner wall surface of the outer conductor 21 closely fits to the outer wall surface of the dielectric unit 10. The axial length of the outer conductor 21 is selected to be a $\frac{1}{4}$ wave length of a propagating electric wave. The axial length of the dielectric unit 10 is selected to be approximately two-thirds of the total axial length of the outer conductor 21. Accordingly, a cavity 22 of approximately one third of the axial length of the outer conductor 21 is formed in the portion close to one end of the outer conductor 21, where no dielectric member exists.

A central rod 23 made of ceramic is inserted into the hollow portion of the dielectric unit 10 for the purpose of reinforcement. The central rod 23 is selected to be of the same axial length as that of the outer conductor 21. A silver paste having a good high frequency characteristic and of a good adhesiveness to the dielectric unit 10 is formed, by baking, on the outer wall surface of the central rod 23, thereby forming an inner conductor 24. The $\frac{1}{4}$ wave length coaxial resonator thus formed is housed in a metallic casing formed with a bottomed hole having an inner diameter which is equal to the outer diameter of the outer conductor 21. One end of the outer conductor 21 and one end of the inner conductor 24 are short-circuited by the casing, whereby a short-circuit end is formed.

In such conventional $\frac{1}{4}$ wave length coaxial TEM resonators the effective dielectric constant of the resonator is considerably decreased at the cavity portion 22 formed at the short-circuit end 25. Usually the electric field of the fundamental wave is zero or nearly zero at the short-circuit end of the coaxial resonator. Therefore, even if the dielectric constant of the substance such as air or vacuum existing between the outer conductor 21 and the inner conductor 24 is low, little influence is exerted upon the resonant frequency. However, the electric field of the third harmonic is large at the short-circuit end 25 and the third harmonic is influenced by a small effective dielectric constant of the substance or vacuum existing at the cavity portion 22. Therefore, resonance of the third harmonic which is a cause to degrade a spurious characteristic becomes liable to occur at a higher frequency region and a spurious characteristic can be improved as compared with a coaxial resonator which does not comprise the cavity portion 22.

Meanwhile, in the case of the FIG. 1 coaxial resonator, the inner conductor 24 has been formed by baking silver. However, usually a dopant material is employed in baking silver and the fact that pure silver is not employed degrades electrical conductivity and increases loss and thus reduces the quality factor.

In some cases, two $\frac{1}{4}$ wave length coaxial resonators are combined so that the short-circuit ends thereof may be electrically coupled to serve as a half-wave coaxial resonator. In such cases, it is difficult to electrically couple the short-circuit ends of the above described $\frac{1}{4}$ wave length coaxial resonators, with the result that the electrical conductivity at the contacting portion is degraded.

Furthermore, in order to implement a $\frac{1}{2}$ wave length coaxial resonator using two $\frac{1}{4}$ wave length coaxial resonators, it is necessary to inductively couple these $\frac{1}{4}$ wave length coaxial resonators at the respective short-circuit ends, with the result that some inductive coupling means need be provided for the purpose of inductively coupling the two coaxial resonators. Therefore, a problem is encountered that a structure for implementing a $\frac{1}{2}$ wave length coaxial resonator using two conventional $\frac{1}{4}$ wave length coaxial resonators becomes complicated and expensive.

SUMMARY OF THE INVENTION

Briefly described, the present invention comprises a $\frac{1}{4}$ wave length coaxial resonator having outer and inner conductors coaxially disposed and spaced apart from each other and a short-circuit end for short-circuiting the outer and inner conductors and a dielectric material disposed between the outer and inner conductors, the outer and inner conductors being of a $\frac{1}{4}$ wave length in the axial direction, characterized in that the coaxial resonator comprises a metallic formed conductive member made of a unitary member having an outer hollow cylindrical portion and an inner cylindrical portion coaxially disposed and spaced apart from each other and a radial connecting portion connecting the outer and inner cylindrical portions at the end thereof, the outer and inner cylindrical portions constituting at least portions of the outer and inner conductors, respectively, and the radial connecting portion constituting the short-circuit end, the metallic formed conductive member having a space defined between the outer and inner cylindrical portions and at least one open end, and a hollow cylindrical dielectric unit inserted into the space from the open end of the metallic formed conductive member, the hollow cylindrical dielectric member constituting the dielectric material.

According to the present invention, the outer and inner cylindrical portions and the radial connecting portion are integrally made of a unitary metallic member, which facilitates a process of manufacturing the same. Preferably, the metallic formed conductive member is made of a unitary metallic material of such as brass formed by an impact extruding process or impact forging process. Furthermore, according to the present invention, a half-wave length coaxial resonator, a filter or the like can be implemented with relative ease. More specifically, since the radial connecting portion and the outer and inner cylindrical portions are made of a unitary metallic member, a half-wave length coaxial resonator can be provided by simply connecting the radial connecting portions of two metallic formed members of the resonators by soldering the said portions. In addition, a filter can be simply provided by simply cascade connecting through capacitive coupling a plurality of half-wave length coaxial resonators structured as described above.

In a preferred embodiment of the present invention, a metallic formed member for uniting two independent $\frac{1}{4}$ wave length coaxial resonators is provided by using a metallic formed member integrally formed in such structure that the radial connecting portion at one end of one $\frac{1}{4}$ wave length resonator for short-circuiting the outer and inner cylindrical portions and the radial connecting portion at one end of the other $\frac{1}{4}$ wave length coaxial resonator for short-circuiting the outer and inner cylindrical portions may be common and by inserting a dielectric unit to each of one and the other $\frac{1}{4}$ wave length coaxial resonators from the open end of each resonator, i.e. one and the other end of the above described unitary metallic formed member. If an inductive coupling portion is formed at the radial connecting portion, the above described two $\frac{1}{4}$ wave length coaxial resonators are inductively coupled and as a result a $\frac{1}{2}$ wave length coaxial resonator can be implemented with relative ease.

Accordingly, a principal object of the present invention is to provide a coaxial resonator adapted for preventing degradation of the quality factor by improving electrical conduction between an outer and inner cylindrical portions through a short-circuit portion.

Another object of the present invention is to provide a coaxial resonator which is simple in manufacture and inexpensive in cost.

A further object of the present invention is to provide a coaxial resonator of an improved structure wherein a half-wave length coaxial resonator can be implemented with ease by using two dielectric units for $\frac{1}{4}$ wave length coaxial resonators and by inductively coupling two $\frac{1}{4}$ wave length coaxial resonators.

Still a further object of the present invention is to provide a coaxial resonator suited for implementing a filter through cascade connection of a plurality of $\frac{1}{4}$ wave length coaxial resonators.

Still another object of the present invention is to provide a unitary coaxial resonator including two electrically independent $\frac{1}{4}$ wave length coaxial resonators in a united manner.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
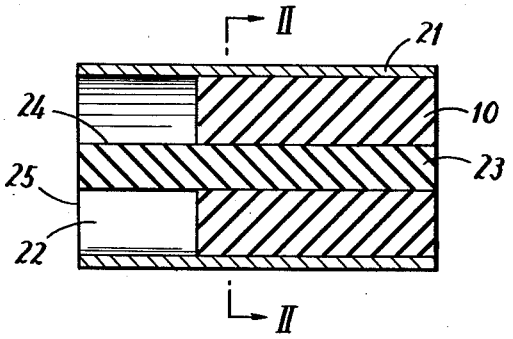
FIG. 1 PRIOR ART
FIG. 1 is a sectional view showing a prior art $\frac{1}{4}$ wave length coaxial TEM resonator.
Figure 2:
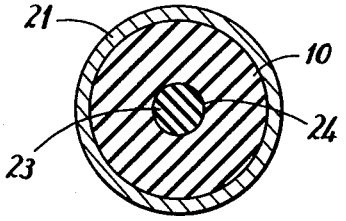
FIG. 2 PRIOR ART
FIG. 2 is a sectional view taken along the line II—II in FIG. 1.
Figure 3:
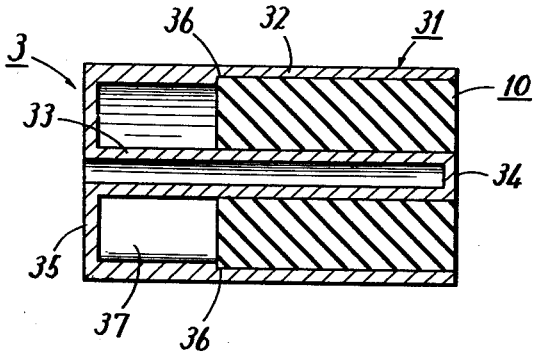
FIG. 3 is a sectional view of one embodiment of the present invention.
Figure 4:
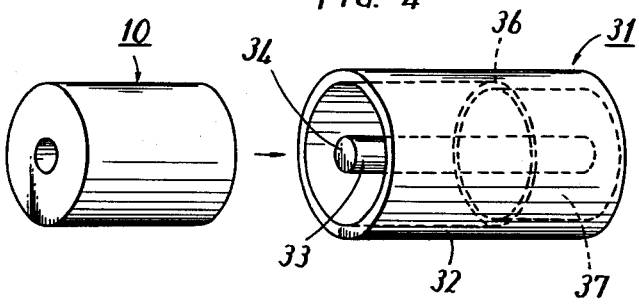
FIG. 4 is a perspective view showing a dielectric unit and a metallic extruded member for use in one embodiment of the present invention.

FIG. 3 is a sectional view of one embodiment of the present invention and FIG. 4 is a perspective view of a dielectric unit and a metallic extruded member of one embodiment of the present invention. Referring to FIGS. 3 and 4, one embodiment of the present invention will be described. A $\frac{1}{4}$ wave length coaxial resonator 3 comprises a dielectric unit 10 and a metallic extruded member 31. As more specifically described below, the metallic extruded member 31 is made of a unitary metallic material of such as brass formed by an impact extruding process or impact forging process, for example, to comprise an outer cylindrical portion 32 and an inner cylindrical portion 33 and a radial connection portion 35 connecting the portions 32 and 33 at one end. The outer cylindrical portion 32 is formed in a cylindrical shape and the axial length thereof is selected to be a $\frac{1}{4}$ wave length of the electric wave. The inner cylindrical portion 33 is also formed in a hollow cylindrical shape, one end 34 of which is closed, and the axial length thereof is also selected to be a $\frac{1}{4}$ wave length of the electric wave as in the case of the outer cylindrical portion 32. Alternatively, one end 34 of the inner cylindrical portion 33 may be opened. The inner cylindrical portion 33 may be a solid cylindrical shape. A space is formed between the outer and inner cylindrical portions 32 and 33 for allowing the insertion of a hollow cylindrical dielectric unit 10 as shown in FIG. 1. One end of the outer and inner cylindrical portions 32 and 33 is opened to permit the insertion of the dielectric unit 10 into the above described space, while the other end of the outer and inner cylindrical portions 32 and 33 is electrically closed so that the outer and inner cylindrical portions 32 and 33 are electrically short-circuited by means of the radial connecting portion 35.

The axial directional length of the dielectric unit 10 is selected to be approximately two-thirds of the axial length of the outer cylindrical portion 32. An engaging portion 36 for engagement with one end of the dielectric unit 10 is formed on the inner wall surface of the outer cylindrical portion 32 at the position commensurate with the axial length of the dielectric unit 10 from the open end. The dielectric unit 10 is inserted from the open end of the metallic extruded member 31 so that one end of the dielectric unit 10 may be engaged by the engaging portion 36. Since the axial length of the dielectric unit 10 has been selected to be shorter than the axial length of the outer cylindrical portion 32, a cavity portion 37 is formed between the outer and inner cylindrical portions 32 and 33 at the region close to the radial connecting portion 35. Preferably, the metallic extruded member 31 is plated with nickel (Ni) or tin (Sn), while the outer and inner wall surfaces of the dielectric unit 10 are metallized. As a result, electrical conduction between the dielectric unit 10 and the outer and inner cylindrical portions 32 and 33 can be enhanced.

Figure 5:
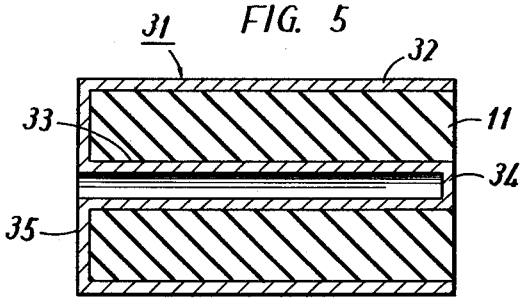
FIG. 5 is a sectional view of another embodiment of the present invention.

FIG. 5 is a sectional view of another embodiment of the present invention. The FIG. 5 embodiment is similar to the previously described FIG. 3 embodiment, except for the following respects. Specifically, the axial length of the dielectric unit 11 is selected to be the same as the axial length of the outer cylindrical portion 32, so that the space between the outer and inner cylindrical portions 32 and 33 is fully filled with the dielectric unit 11. Since the axial length of the dielectric unit 11 has been selected to be substantially the same as the axial length of the outer cylindrical portion 32 in the FIG. 5 embodiment, it is not necessary to form the engaging portion 36 shown in FIG. 3.

FIGS. 6 to 9 are views for depicting a method for manufacturing the metallic extruded member shown in FIG. 3. Now referring to FIGS. 6 to 9, a method of manufacturing the metallic extruded member 31 will be described in the following. At the outset an extruding die and punch 61 and 62 are prepared. The die 61 is formed in a hollow cylindrical shape corresponding to the geometry of the outer cylindrical portion 32 (see FIG. 4) of the metallic extruded member 31 and having an opened gap or groove 611 at one end thereof. The width in the diametrical direction of the gap 611 is selected to be substantially the same as the thickness of the outer cylindrical portion 32. The die 61 is further provided with a bore 612 corresponding to the inner cylindrical portion 33 (see FIG. 4) disposed coaxially with the above described gap 611. The inner diameter of the bore 612 is selected to be substantially the same as the outer diameter of the inner cylindrical portion 33. The axial length of the portion 613 defined between the gap 611 and the bore 612 is formed to be shorter, by the thickness of the radial connecting portion 35, than the axial length of the outer wall portion 614 of the gap 611.

The punch 62 comprises a rod portion 621 having an outer diameter which is substantially the same as the inner diameter of the inner cylindrical portion 33. The length of the rod portion 621 is formed to be shorter than the axial length of the bore 612 of the die 61.

These two die and punch 61 and 62 are disposed to be faced to each other so that the rod portion 621 of the punch 62 may be inserted into the bore 612 of the die 61. A cylindrical source material 7 of brass, for example, is disposed between the die and punch 61 and 62. Then a strong impact is applied between both die and punch 61 and 62, so that the brass 7 is pressed between the die and punch 61 and 62. Then, the brass 7 is pressed into the gap 611 of the die 61 and the space defined between the bore 612 and the rod member 621. Thereafter the die and punch 61 and 62 are separated and as a result a metallic extruded member 31, which is sufficiently rigid to be self-supporting, is obtained. See FIG. 4. More preferably, the metallic extruded member 31 thus obtained is then plated with nickel or tin. Thus, the metallic extruded member 31 of a desired geometry can be provided with relative ease by means of an impact extruding process using the above described die and punch 61 and 62.

Figure 10:
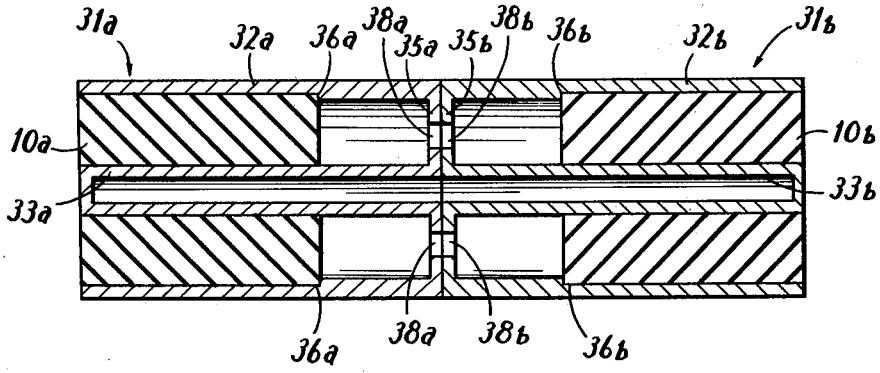
FIG. 10 is a sectional view of a half-wave length coaxial resonator implemented using two $\frac{1}{4}$ wave length coaxial resonators shown in FIG. 3.
Figure 6:
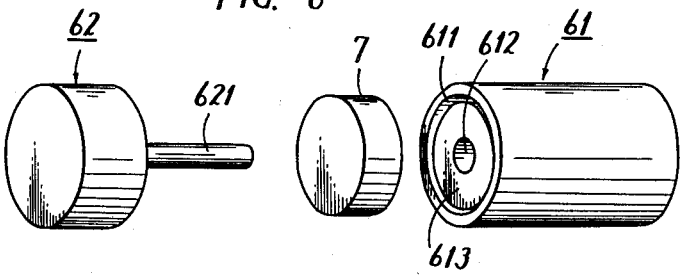
FIGS. 6 to 9 are views for depicting a method for manufacturing a metallic extruded member shown in FIG. 3.
Figure 7:
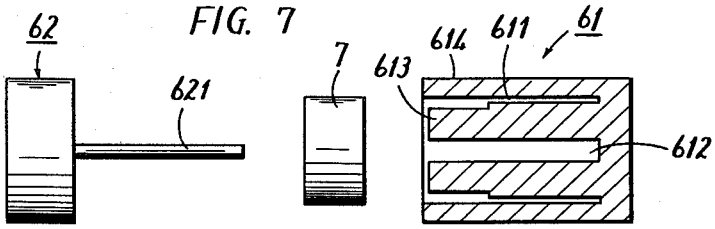
Figure 8:
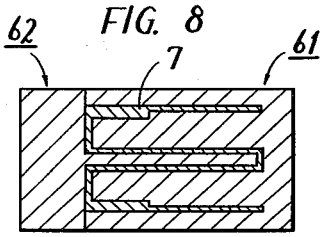
Figure 9:
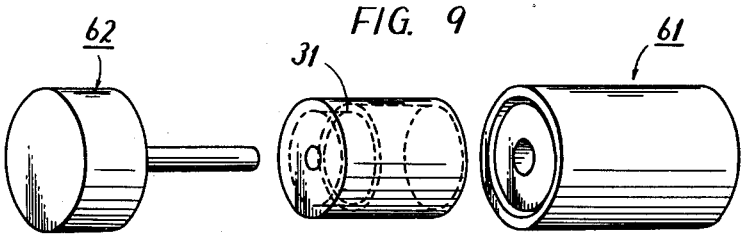
Figure 11:
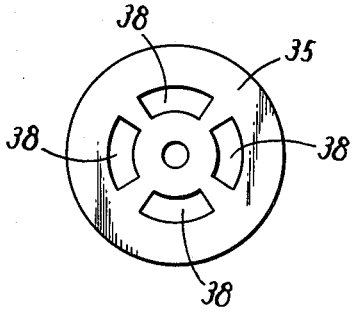
FIG. 11 is a view showing a radial connecting portion of a $\frac{1}{4}$ wave length coaxial resonator included in FIG. 10.

FIG. 10 is a sectional view of a half-wave length coaxial resonator implemented using two $\frac{1}{4}$ wave length coaxial resonators shown in FIG. 3 so as to be inductively coupled to each other and FIG. 11 is a view showing the radial connecting portion of the $\frac{1}{4}$ wave length coaxial resonator included in FIG. 10.

Referring to FIGS. 10 and 11, two $\frac{1}{4}$ wave length coaxial resonators 3 as shown in FIG. 3 are prepared and a plurality of inductive coupling windows **38*a* and 38*b* (identified generally as 38 in FIG. 11) are formed in rotational symmetry, as shown in FIG. 11, on the respective radial connecting portions 35*a* and 35*b*. The radial connection portions 35*a* and 35*b* of these two coaxial resonators are jointed by injecting molten solder therebetween from the outer wall surfaces 32*a* and 32*b*, whereby the radial connecting portions 35*a* and 35*b*** are electrically and mechanically coupled.

A half-wave length coaxial resonator is thus implemented by inductively coupling two of the $\frac{1}{4}$ wave length coaxial resonators 3 and 3 by electrically and mechanically connecting the respective radial connecting portions, with the inductive coupling windows **38*a* and 38*b* formed on the respective radial connecting portions 35*a* and 35*b* of these two $\frac{1}{4}$ wave length coaxial resonators 3 and 3**.

Figure 12:
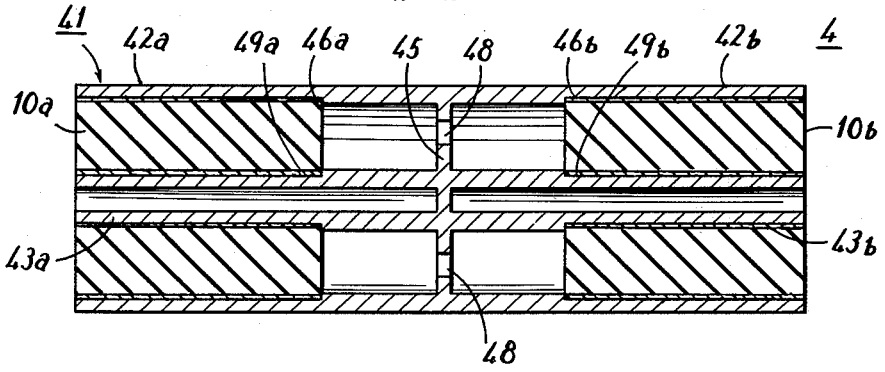
FIG. 12 is a sectional view of a further embodiment of the present invention.

FIG. 12 is a sectional view of another embodiment of the present invention. The FIG. 12 embodiment comprises a half-wave length coaxial resonator 4 made of a unitary metallic extruded member 41. More specifically, the common radial connecting portion 45 and the outer cylindrical portions **42*a* and 42*b* and the inner cylindrical portions 43*a* and 43*b* are integrally formed using a unitary member. A plurality of inductive coupling windows of rotational symmetry are formed at the radial connecting portion 45. The total axial length of those of the outer cylindrical portions 42*a* and 42*b* and the total axial length of those of the inner cylindrical portions 43*a* and 43*b* are selected to be a half-wave length of the electric wave. The inner cylindrical portions 43*a* and 43*b* may be provided with the engaging portions 49*a* and 49*b* similarly to the engaging portions 46*a* and 46*b* of the outer cylindrical portions 42*a* and 42*b*, although such engaging portions 46*a* and 46*b* are not indispensable. By thus forming the metallic extruded member 41** integrally using a unitary member, the work required to electrically and mechanically couple the radial connecting portions of the ¼ wave length coaxial resonators to implement a half-wave length coaxial resonator, as described previously with reference to FIG. 10, can be eliminated. Furthermore, a ½ wave length coaxial resonator can be implemented with relative ease by forming inductive coupling windows 48 at the common radial connecting portion 45 and by inductively coupling the two ¼ wave length coaxial resonators. Meanwhile, a process for manufacturing such metallic extruded member 41 will be described in more detail subsequently with reference to FIGS. 14 to 17, below.

Figure 12A:
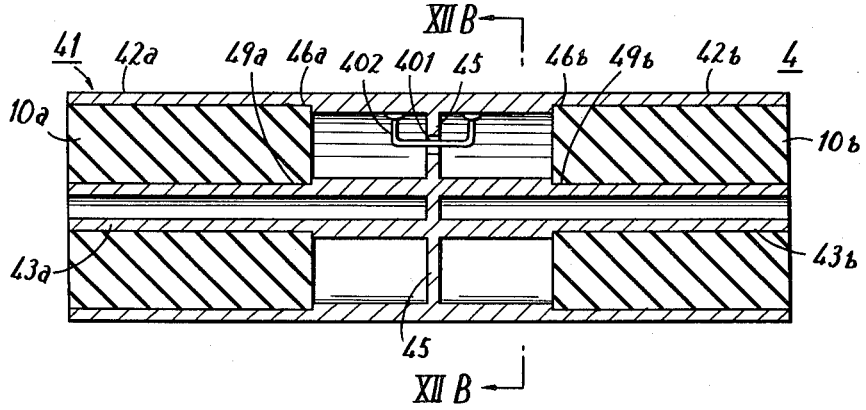
FIG. 12A is a sectional view of another embodiment of the present invention.
Figure 12B:
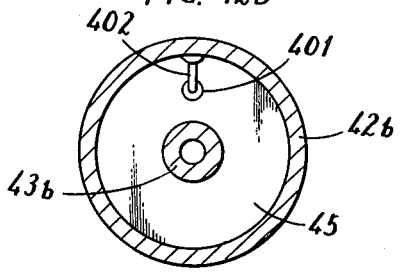
FIG. 12B is a sectional view taken along the line XIIB—XIIB in FIG. 12A.

FIG. 12A is a sectional view of another embodiment of the present invention and FIG. 12B is a longitudinal sectional view taken along the line XIIB—XIIB in FIG. 12A. The FIG. 12A embodiment is substantially the same as the previously described FIG. 12 embodiment, except for the following respects. Specifically, the ½ wave length coaxial resonator of the embodiment shown comprises two ¼ wave length coaxial resonators inductively coupled by means of a coupling conductor 402. To that end, the radial connecting portion 45 is formed with an aperture 401 and the coupling conductor 402 is provided to extend through the aperture 401. One end of the coupling conductor 401 is bent at approximate right angle and the tip end thereof is soldered to the inner wall surface of the outer cylindrical portion 42*a* of one resonator. The other end of the coupling conductor 402 is also bent at approximate right angle and the tip end thereof is soldered to the inner wall surface of the outer cylindrical portion 42*b* of the other resonator. Thus one coaxial resonator and the other coaxial resonator are inductively coupled by means of the coupling conductor 402. If desired, an insulating bushing, not shown, may be provided around the coupling conductor 402 inserted through the aperture 401.

Figure 12D:
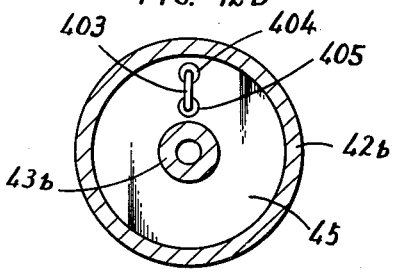
FIG. 12D is a sectional view taken along the line XIID—XIID in FIG. 12C.
Figure 12C:
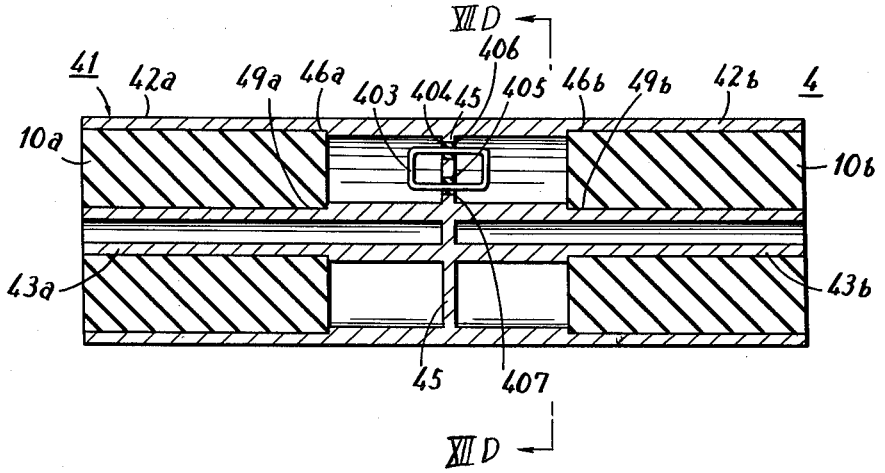
FIG. 12C is a sectional view of a further embodiment of the present invention.

FIG. 12C is a sectional view of a further embodiment of the present invention and FIG. 12D is a sectional view taken along the line XIID—XIID in FIG. 12C. The FIG. 12C embodiment comprises a ring shaped coupling conductor 403 in lieu of the coupling conductor 402 shown in the previously described FIG. 12A embodiment, so that the two ¼ wave length coaxial resonators may be inductively coupled by means of the coupling conductor 403. To that end, the radial connecting portion 45 is formed with two apertures 404 and 405. U letter shaped coupling conductors 403 are inserted through these two apertures and the end portion of each is bent at approximately a right angle and the tip end thereof is connected, so that the coupling conductor may be formed in a ring shape. Meanwhile, insulating bushings 406 and 407 may be provided in these two apertures 404 and 405.

Figure 12E:
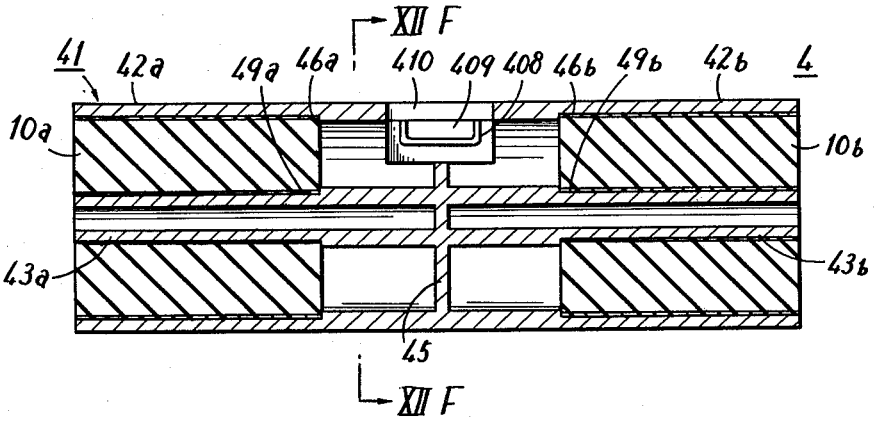
FIG. 12E is a sectional view of still a further embodiment of the present invention.
Figure 12F:
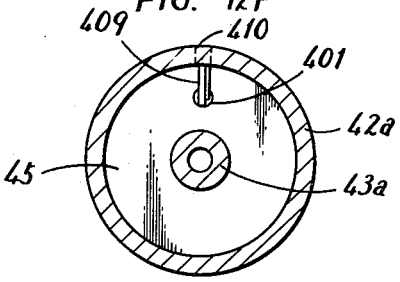
FIG. 12F is a sectional view taken along the line XIIF—XIIF in FIG. 12E.
Figure 12G:
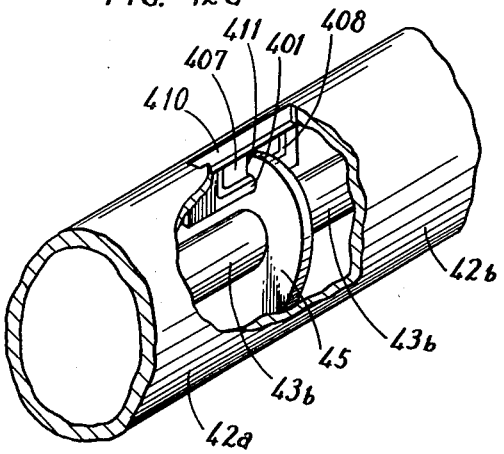
FIG. 12G is a fragmentary perspective view showing a major portion of the radial connecting portion of the FIG. 12E $\frac{1}{2}$ wave length coaxial resonator.

FIG. 12E is a sectional view of still a further embodiment of the present invention and FIG. 12F is a sectional view taken along the line XIIF—XIIF in FIG. 12E, while FIG. 12G is a perspective, partially fragmentary, view showing the radial connecting portion of the FIG. 12E embodiment. The FIG. 12E embodiment comprises a print circuit board 409 formed with a coupling conductor 408 in lieu of the coupling conductor 402 of the previously described FIG. 12A embodiment, so that the two ¼ wave length coaxial resonators may be inductively coupled. More specifically, the print circuit board 409 of a square shape is prepared and a U letter shaped coupling conductor 408 is formed on the print circuit board 409. On the other hand, the outer cylindrical portions 42*a* and 42*b* around the radial connecting portion 45 are formed with grooves 410 extending in the axial direction for inserting the above described print circuit board 409. The radial connecting portion 45 is also formed with an aperture 401 at an approximate central portion between the outer cylindrical portions 42*a* and 43*a*. The aperture 401 is aimed to prevent the coupling conductor 408 from being in contact with the radial connecting portion 45. Furthermore, the radial connecting portion 45 is formed with a slit 411 extending from the outer cylindrical portion 42*a* to reach the above described aperture 401. The above described print circuit board 409 is inserted from the groove 410 and is fitted into the slit 411 of the radial connecting portion 45. One end of the coupling conductor 408 is soldered to the inner wall surface of the outer cylindrical portion 42*a* and the other end of the coupling conductor 408 is soldered to the inner wall surface of the outer cylindrical portion 42*b*.

Figure 12H:
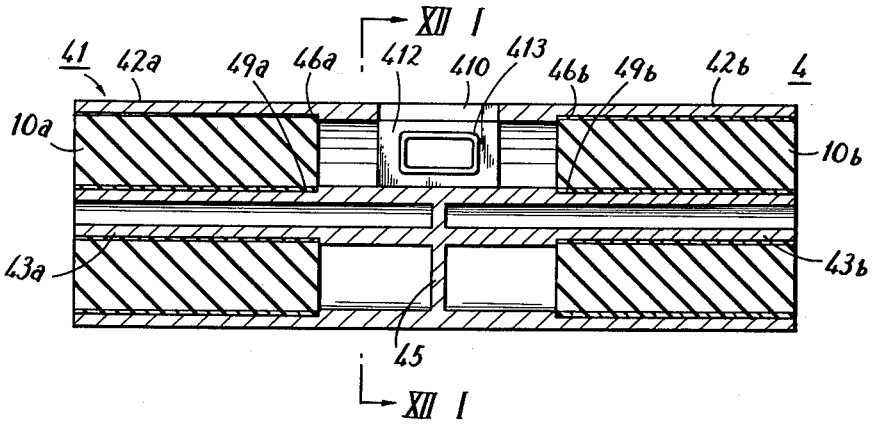
FIG. 12H is a sectional view of still a further embodiment of the present invention.
Figure 12I:
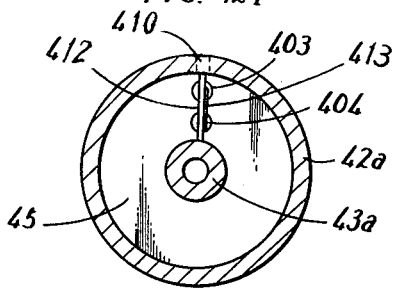
FIG. 12I is a sectional view taken along the line XIII—XIII in FIG. 2H.
Figure 14:
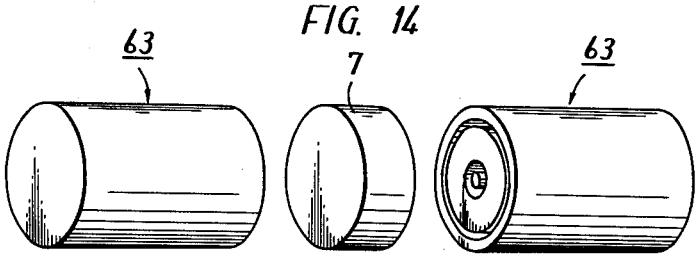
FIGS. 14 to 17 are views for depicting a method for manufacturing a metallic extruded member shown in FIG. 12.
Figure 15:
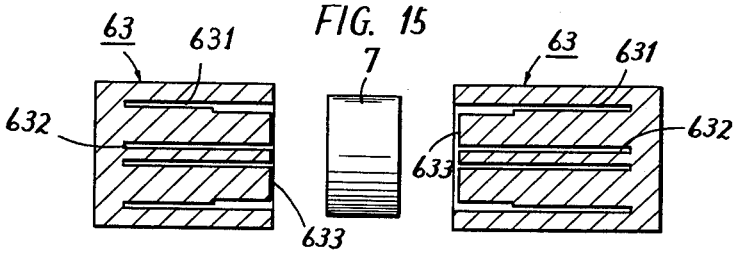
Figure 16:
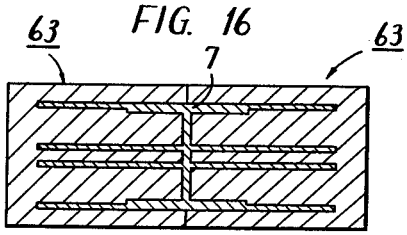
Figure 17:
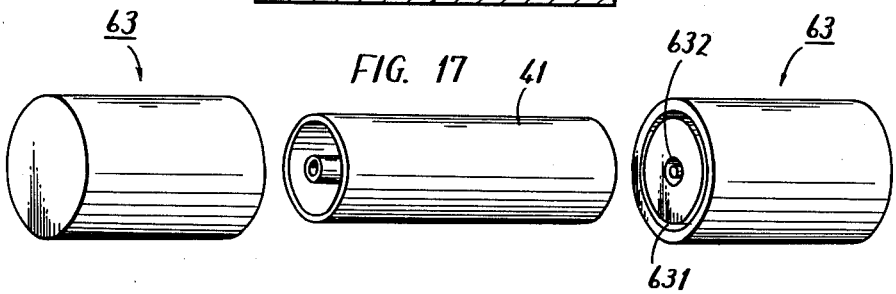

FIG. 12H is a sectional view of still a further embodiment of the present invention and FIG. 12I is a sectional view taken along the line XII/I—XII/I in FIG. 12H. The embodiment shown in FIGS. 12H and 12I is substantially the same as the embodiment shown in FIGS. 12E to 12G, except for formation of a ring shaped coupling conductor 413 on a print circuit board 412. Since the coupling conductor 413 is formed in a ring shape on the print circuit board 412, it is necessary to form two apertures 403 and 404 so that the coupling conductor 413 may not be in contact with the radial connecting portion 45.

Figure 13:
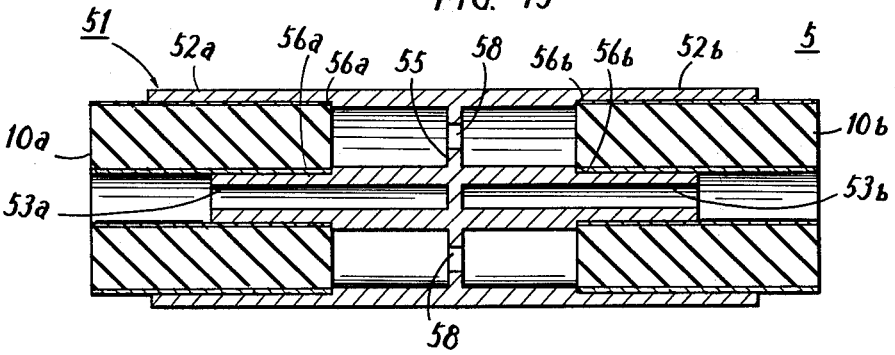
FIG. 13 is a sectional view of still a further embodiment of the present invention.

FIG. 13 is a sectional view of still a further embodiment of the present invention. The FIG. 13 embodiment is structured such that the total axial length of those of the outer cylindrical portions 52*a* and 52*b* of the metallic extruded member 51 may be shorter than the half-wave length and the total axial length of those of the inner cylindrical portions 53*a* and 53*b* may be much shorter than the total axial length of those of the outer cylindrical portions 52*a* and 52*b*. The dielectric units 10*a* and 10*b* are inserted from both ends of the metallic extruded member 51 so that a portion of each of the dielectric member protrudes from each end of the metallic extruded member 51. A portion of each of the dielectric units 10*a* and 10*b* protrudes from each end of the metallic extruded member 51 in the case of the FIG. 13 embodiment. However, since the outer wall surface and the inner wall surface of the respective dielectric units 10*a* and 10*b* have been metallized (so that metallized layers are formed) an ample electric conduction can be established between such metallized layers and the inner wall surfaces of the outer cylindrical portions 52*a* and 52*b* and the outer wall surfaces of the inner cylindrical portions 53*a* and 53*b*. In such a case, since the axial length of the metallic extruded member 51 has been selected to be shorter than that of the metallic extruded member 41 shown in FIG. 12, the metallic material can be reduced and hence the dielectric resonator 5 can be fabricated with a less expensive cost. Meanwhile, it follows that according to the FIG. 13 embodiment the outer and inner conductors of the coaxial resonator are comprised of the outer and inner cylindrical portions 53*a* and 53*b* and the metallized layers formed on the outer and inner walls of the dielectric units 10*a* and 10*b* protruding from the outer and inner cylindrical portions 53*a* and 53*b*, respectively.

FIGS. 14 to 17 are views for depicting a process for manufacturing a metallic extruded member 41 shown in FIG. 12. Now referring to FIGS. 14 to 17, a process for manufacturing the metallic extruded member 41 will be described in the following. At the outset two of die/-punches 63 are prepared. Each of the die/punches 63 is formed with a gap 631 which is similar to the gap 611 of the dies 61 previously described in conjunction with FIG. 6. Each of the die/punches 63 is further formed with another gap 632 coaxially disposed with respect to the above described gap 631 so as to be in a cylindrical shape corresponding to the inner cylindrical portion 43*a* of the metallic extruded member 41 and so as to be opened at one end. The width of the gap 632 in the radial direction is selected to be substantially the same as the thickness of the inner cylindrical portion 43*a*. The two die/punches 63 thus structured are disposed face to face and a source material 7 of brass and in a cylindrical shape is disposed therebetween. Then a strong impact is applied between these two die/punches 63 so that the brass 7 is pressed. Then the brass 7 is pressed into the gap 631 and the bore 632 of each of these die/punches 63. Thereafter the die/punches 63 are separated and as a result the metallic extruded member 41 is provided.

More preferably, the metallic extruded member 41 is wholly plated with nickel (Ni) or tin (Sn). The metallic extruded member 41 can thus be formed with relative ease by merely preparing the die/punches 63 and by applying an impact extruding process. Meanwhile, the protrusions corresponding to the inductive coupling windows 48 of the metallic extruded member 4 are formed at the one end 633 of one of the die/punches 63, although these are not shown in the figure. Therefore, when the metallic extruded member 4 is formed by applying a strong impact to these die/punches 63, the inductive coupling windows 48 are formed at the radial connecting portion 45.

Figure 18:
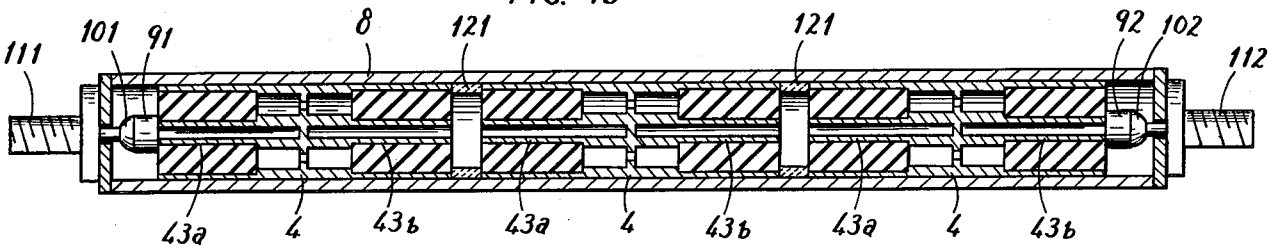
FIG. 18 is a sectional view of a filter implemented by cascade connecting a plurality of half-wave length coaxial resonators shown in FIG. 12.
Figure 19:
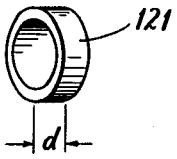
FIG. 19 is a perspective view of a specific example of a dielectric spacer included in FIG. 18.

FIG. 18 is a sectional view of a filter implemented by cascade connecting a plurality of the half-wave length coaxial resonators shown in FIG. 12 and FIG. 19 is a perspective view showing a specific example of the dielectric spacer included in FIG. 18. Referring to FIG. 18, a casing 8 is formed in a cylindrical shape using a conductive material such as duralumin. For example, three of the half-wave length coaxial resonators 4 are housed in the casing 8 so that these are arranged in a tandem fashion. The input end of these half-wave length coaxial resonators 4 series housed in the casing 8 is coupled to an input coupling capacitor 91 and the output end of the above described half-wave length coaxial resonators 4 is coupled to an output coupling capacitor 92. These coupling capacitors 91 and 92 may each comprise a cylindrical dielectric member having electrodes at both end surfaces. One electrode of the coupling capacitor 91 is connected to the inner cylindrical portion 43*a* of the first stage resonator 4 and the other electrode of the coupling capacitor 91 is connected to an input matching connecting terminal 101. One electrode of the coupling capacitor 92 is connected to the inner cylindrical portion 43*b* of the last stage resonator 4 and the other electrode of the coupling capacitor 92 is connected to an output matching connecting terminal 102. The input matching connecting terminal 101 is connected to an input coaxial connector 111 and the output matching connecting terminal 102 is connected to an output coaxial connector 112. The respective resonators 4 are coupled through stray capacitances controlled by the spacing formed by means of the dielectric spacer 121, for example. The dielectric spacer 121 may comprise a ring having an axial length d made of a dielectric material of a low dielectric constant such as forsterite, as shown in FIG. 19. The degree of coupling between the resonators can be adjusted by changing the distance d. Thus, a filter which is easy of assemblage and is small sized can be provided by inserting a plurality of the half-wave length coaxial resonators 4 in the cylindrical case 8 for cascade connection. Since a filter is implemented using such half-wave length coaxial resonators having the electrical conductivity improved as shown in FIG. 12, the electrical conductivity can be enhanced as a whole.

Meanwhile, although the above described FIG. 18 embodiment was adapted such that the respective coaxial resonators 4 are coupled by means of the dielectric spacer 121, it is pointed out that the dielectric spacer can be dispensed with. More specifically, the dielectric unit 10*b* of the one side of the first stage coaxial resonator 4 is formed to extend longer by the length commensurate with that of the dielectric spacer 121. The dielectric unit is inserted from the open end of one side of the metallic extruded member 41 and is protruded from the open end by the length $\alpha$ commensurate with that of the dielectric spacer 121. The metallized layers are formed only on the portions of the outer and inner wall surfaces of the dielectric unit which portions are inserted into the metallic extruded member 41, while no metallized layers are formed on the protruding portion. As a result, a capacitive coupling can be achieved to the other coaxial resonator 4 through the portion of the dielectric unit protruding from the metallic extruded member. By thus integrally forming the dielectric unit and the dielectric spacer, the number of components constituting the filter can be decreased and as a result a structure of the filter can be simplified.

Figure 20:
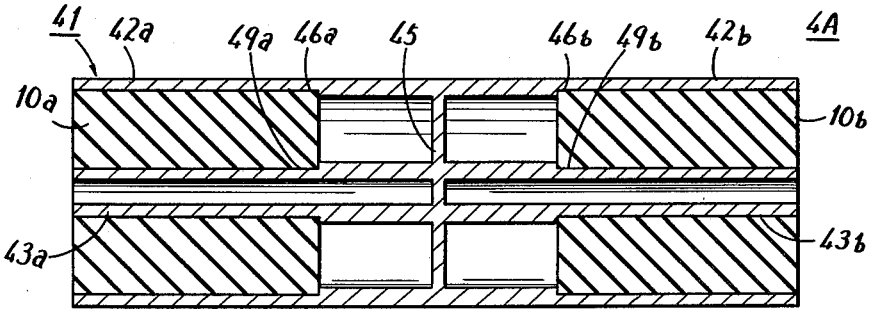
FIG. 20 is a sectional view showing still a further embodiment of the present invention.

FIG. 20 is a sectional view of still a further embodiment of the present invention. The FIG. 20 embodiment is substantially the same as the previously described FIG. 12 embodiment, except for the following respects. Specifically, the FIG. 20 $\frac{1}{4}$ wave length coaxial resonators are not formed with an inductive coupling widow 48 as shown in FIG. 12 at the radial connecting portion 45. In other words, the FIG. 20 embodiment has the radial connecting portion 45 closed. Therefore, the two $\frac{1}{4}$ wave length coaxial resonators are not electrically coupled and hence these each individually operate, although the same are mechanically coupled. Accordingly, by selecting the outer cylindrical portion 42*a* and the inner cylindrical portion 43*a* of one resonator and the outer cylindrical portion 42*b* and the inner cylindrical portion 43*b* of the other resonator to be of different $\frac{1}{4}$ wave lengths of different frequencies, these two $\frac{1}{4}$ wave length coaxial resonators can be made to cause resonance at the respective frequencies.

Figure 21:
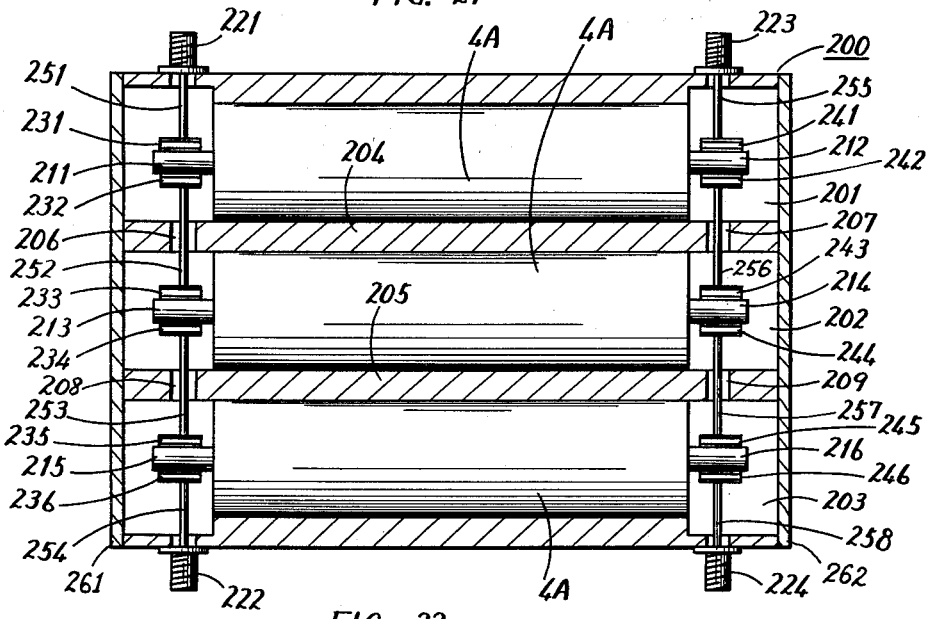
FIG. 21 is a sectional view showing one example of a filter structured using such coaxial resonators as shown in FIG. 20.

FIG. 21 is a sectional view showing one example of a filter structured using the $\frac{1}{4}$ wave length coaxial resonators as shown in FIG. 20. The FIG. 21 filter comprises two sets of filters housed in a single casing 200. The casing 200 is made of a metallic conductor of such as duralumin. The casing 200 is formed with apertures 201 to 203 for housing three coaxial resonators 4A as shown in FIG. 20. A partition wall 204 for partitioning the apertures 201 and 202 is formed with apertures 206 and 207 for penetration of lead wires 252 and 256 to be described subsequently at one and the other end portions of the partition wall 204, respectively. Furthermore, a partition wall 205 for partitioning the apertures 202 and 203 is similarly formed with apertures 208 and 209 for penetration of lead wires 253 and 257 to be described subsequently, respectively. Input coaxial connectors 221 and 223 and output coaxial connectors 222 and 224 are provided at the side wall of the casing 200.

The coaxial resonators 4A are housed in the respective apertures 201 to 203 of the casing 200 thus formed. Each of the coaxial resonators 4A is fixed with a conductive adhesive agent so that the respective outer cylindrical portions 42*a* and 42*b* may be in contact with the inner wall surfaces of the apertures 201 to 203. Terminal electrodes 211 to 216 are inserted to the open end of the inner cylindrical portions 43*a* to 43*b* of the respective coaxial resonators 4A. One electrode of each of chip capacitors 231 to 246 is connected to each of the terminal electrodes 211 to 216. The center conductor of the input coaxial connector 221 and the other electrode of the chip capacitor 231 are connected by a lead wire 251 and the other electrode of the chip capacitor 232 and the other electrode of the chip capacitor 233 are connected by a lead wire 252 extending through the aperture 206. The other electrode of the chip capacitor 234 and the other electrode of the chip capacitor 235 are connected by a lead wire 253 extending through the capacitor 208. The other electrode of the chip capacitor 236 and the center conductor of one output coaxial connector 222 are connected by a lead wire 254.

The center conductor of the other input coaxial connector 223 and the other electrode of the chip capacitor 241 are connected by a lead wire 255. The other electrode of the chip capacitor 242 and the other electrode of the chip capacitor 243 are connected by a lead wire 253 extending through the aperture 207. The other electrode of the chip capacitor 244 and the other electrode of the chip capacitor 245 are connected by a lead wire 257 extending through the aperture 209. The other electrode of the chip capacitor 246 and the center conductor of the other output coaxial connector 224 are connected by a lead wire 258. The opening portion of the casing 200 is sealed or closed by metallic plates 261 and 262.

Figure 22:
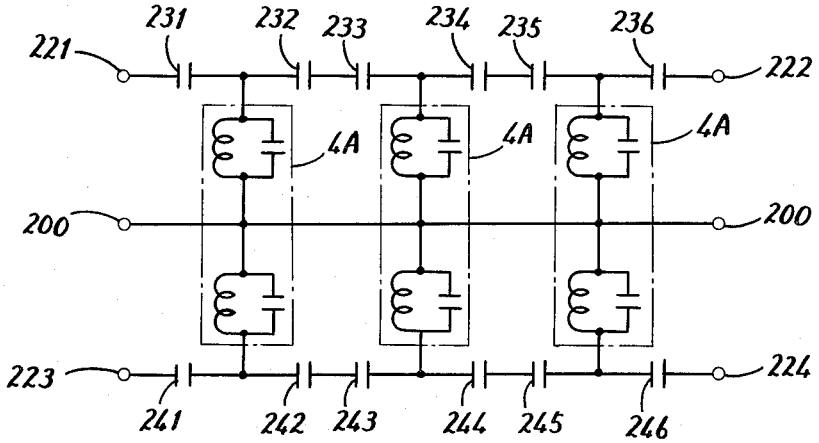
FIG. 22 is an equivalent diagram of the FIG. 21 filter.

An equivalent electrical diagram of the filter structured described above is shown in FIG. 22. More specifically, the filter at one side comprises a series connection of the chip capacitors 231 to 236 between the input coaxial connector 221 and the output coaxial connector 222 and a first LC circuit included in an equivalent circuit manner in the coaxial resonator 4A is connected between the junction of the chip capacitors 231 and 232 and the casing 200, a second LC circuit included in an equivalent circuit manner in the coaxial resonator 4A is connected between the junction of the chip capacitors 233 and 234 and the casing 200, and a third LC circuit included in an equivalent circuit manner in the coaxial resonator 4A is connected between the junction of the chip capacitors 235 and 236 and the casing 200.

On the other hand, the filter at the opposite side comprises a series connection of the chip capacitors 241 to 246 between the input coaxial connector 223 and the output coaxial connector 224, and a first LC circuit included in an equivalent circuit manner in the coaxial resonator 4A is connected between the junction of the chip capacitors 241 and 242 and the casing 200, a second LC circuit included in an equivalent circuit manner in the coaxial resonator 4A is connected between the junction of the chip capacitors 243 and 244 and the casing 200, and a third LC circuit included in an equivalent circuit manner in the coaxial resonator 4A is connected between the junction of the chip capacitors 245 and 246 and the casing 200. Thus, the FIG. 20 filter comprises two series of filters housed in the casing 200.

Meanwhile, if the respective resonance frequencies of the coaxial resonators at one side and the coaxial resonators at the other side are selected to be different in the FIG. 20 filter, two filters having different resonance frequencies and housed in one casing 200 is provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A coaxial resonator, comprising:

(A) a first $\frac{1}{4}$ wave length resonator including:

(1) a unitary metallic conductive member of sufficient rigidity to be self-supporting, said metallic conductive member having an outer hollow cylindrical portion and an inner cylindrical portion connected to each other by a radial connected portion, all of said portions being formed of a single metallic member and being integral with one another, said outer cylindrical portion being coaxially disposed with respect to and spaced apart from said inner cylindrical portion, said outer and inner cylindrical portions defining at least portions of outer and inner conductors, respectively, of said resonator, said radial connecting portion connecting said outer and inner cylindrical portions at respective first ends thereof to define a short-circuit end of said resonator, said metallic conductive member having a space defined between said outer and inner cylindrical portions and at least one open end; and (2) a hollow cylindrical dielectric unit stationarily located in said space of said metallic conductive member;

(B) a second $\frac{1}{4}$ wave length coaxial resonator, including:

(1) a unitary metallic conductive member of sufficient rigidity to be self-supporting, said metallic conductive member having an outer hollow cylindrical portion and an inner cylindrical portion connected to each other by a radial connection portion, all of said portions being formed of a single metallic member and being integral with one another, said outer cylindrical portion being coaxially disposed with respect to and spaced apart from said inner cylindrical portion, said outer and inner cylindrical portions defining at least portions of outer and inner conductors, respectively, of said resonator, said radial connecting portion connecting said outer and inner cylindrical portions at respective first ends thereof to define a short-circuit end of said resonator, said metallic conductive member having a space defined between said outer and inner cylindrical portions and at least one open end; and (2) a hollow cylindrical dielectric unit stationarily located in said space of said metallic conductive member; and (C) said radial connecting portions of said first and second $\frac{1}{4}$ wave length coaxial resonators being mechanically connected to each other, said two $\frac{1}{4}$ wave length coaxial resonators being electrically isolated at said radial connecting portions.

2. A $\frac{1}{2}$ wave length coaxial resonator comprising:

(A) first and second ¼ wave length resonators, each of said ¼ wave length resonators including:

(1) a unitary metallic conductive member of sufficient rigidity to be self-supporting, said metallic conductive member having an outer hollow cylindrical portion and an inner cylindrical portion connected to each other by a radial connected portion, all of said portions being formed of a single metallic member and being integral with one another, said outer cylindrical portion being coaxially disposed with respect to and spaced apart from said inner cylindrical portion, said outer and inner cylindrical portions defining at least portions of outer and inner conductors, respectively, of said resonator, said radial connecting portion connecting said outer and inner cylindrical portions at respective first ends thereof to define a short-circuit end of said resonator, said metallic conductive member having a space defined between said outer and inner cylindrical portions and at least one open end; and (2) a hollow cylindrical dielectric unit located in said space of said metallic conductive member;

(B) said radial connecting portions including inductive coupling means for inductively coupling said first and second ¼ wave length coaxial resonators as to form a ½ wave length coaxial resonator, said inductive coupling means comprising a printed circuitboard having an inductive coupling conductor formed thereon, said radial connecting portions each including a slit formed therein and extending from the respective said outer cylindrical portions to the respective said inner cylindrical portions for receiving said printed circuitboard, and said outer cylindrical portions adjacent said radial connecting portions having a groove formed therein and extending in the axial direction for permitting said printed circuitboard to be inserted into said slit in said radial connecting portions.

3. A coaxial resonator in accordance with claim 1 or 2, wherein said inner cylindrical portion is hollow.

4. A coaxial resonator in accordance with claim 1 or 2, wherein for each respective said resonator:

the axial length of said dielectric unit is shorter than the axial length of said outer and inner cylindrical portions; and said dielectric unit is inserted into said space in a region close to said open end such that a cavity portion is formed close to said radial connecting portion.

5. A coaxial resonator in accordance with claim 1 or 2, wherein said metallic conductive member is formed by an impact extruding process from a slug of metal.

6. A coaxial resonator in accordance with claim 1 or 2, wherein said metallic formed conductive member is formed by an impact forging process from a metallic slug.

7. A resonator according to any one of claims 1 or 2, wherein each of said hollow cylindrical dielectric units is stationarily located in said space of its associated metallic conductive member.

8. A coaxial resonator in accordance with claim 2, wherein said inner cylindrical portion is solid.

9. A coaxial resonator in accordance with claim 2, wherein said metallic member includes an engaging portion formed on at least one of the inner wall surface of said outer cylindrical portion and the outer wall surface of said inner cylindrical portion for engaging one of said dielectric unit located in said space.

10. A coaxial resonator in accordance with claim 2, wherein said printed circuit board has an U shaped inductive coupling conductor formed thereon, one end of said conductor being electrically connected to the inner wall surface of said outer cylindrical portion of one of said ¼ wave length coaxial resonators, the other end of said conductor being electrically connected to the inner wall surface of said outer cylindrical portion of the other of said ¼ wave length coaxial resonators.

11. A coaxial resonator in accordance with claim 2, wherein said printed circuit board comprises an inductive coupling conductor formed in a ring shape.

* * * * *